United States Patent [19]

Kinnear

[11] 4,335,931

[45] Jun. 22, 1982

[54] POWER CABLE CONNECTOR WITH RETENTION SPRING

[75] Inventor: Joseph D. Kinnear, Western Springs, Ill.

[73] Assignee: Brad Harrison Company, LaGrange, Ill.

[21] Appl. No.: 173,603

[22] Filed: Jul. 30, 1980

[51] Int. Cl.[3] ..... H01R 13/422

[52] U.S. Cl. ..... 339/217 S; 339/49 R

[58] Field of Search ..... 339/217 S, 49 R

[56] References Cited

U.S. PATENT DOCUMENTS 3,112,149 11/1963 Bachman ..... 339/217 S
3,390,376 6/1968 Nava ..... 339/217 S
3,993,394 11/1976 Cooper ..... 339/217 S
4,147,400 4/1979 Snyder, Jr. et al. ..... 339/217 S
4,269,472 5/1981 Shaffer et al. ..... 339/217 S

*Primary Examiner*—John McQuade
*Attorney, Agent, or Firm*—Mason, Kolehmainen, Rathburn & Wyss

[57] ABSTRACT

A power cable connector for battery cables or the like includes a terminal cantilever-mounted in a cavity in an insulating housing. A retention spring includes a biasing portion with latching structure for retaining the terminal in the cavity. A release tongue on the spring permits the biasing portion to be flexed for withdrawal of the terminal. The release tongue includes a transversely extending barrier portion blocking the gap between the spring and the terminal so that the terminal can be pushed from the cavity without wedging.

10 Claims, 7 Drawing Figures

POWER CABLE CONNECTOR WITH RETENTION SPRING

The present invention relates to power cable connectors and more particularly to improved spring retention structure for retaining yet facilitating selective removal of a terminal from the connector.

Power cable connectors of the type used for battery cable connections in electromotive vehicles typically include an insulating housing containing a pair of terminals mateable with other terminals of a similar connector. Frequently the connectors are engaged and disengaged in a "live" or energized condition. This may occur, for example, if no other switch is provided and the connector is disengaged for battery replacement or to interrupt the battery circuit for any other reason. Due to wear and arcing resulting from engagement and disengagement of live terminals, the terminals must be periodically replaced. Replacement of the connector terminals is typically carried out by relatively unskilled personnel rather than electricians or the like. Moreover, this operation is frequently performed in a hazardous environment where other batteries, charging equipment and the like are present. Consequently, a power cable connector should be designed to permit terminal removal and replacement to be performed easily and safely.

Battery cable connectors of the type widely used in the past include terminal receiving cavities extending longitudinally through the connector housing. A terminal including a contact portion and a cable attachment portion is longitudinally inserted into each cavity. A leaf spring supported in the cavity serves to bias the terminal in a transverse direction and engages the contact portion of the terminal to latch the terminal in the cavity.

In this known connector structure, in order to withdraw the terminal from the connector housing the spring is engaged by a special tool and is flexed away from the terminal. In practice, this has been inconvenient and difficult to accomplish because the terminal is recessed within the housing to prevent a shock hazard and because the spring is hidden in a nearly inaccessible position behind the terminal.

Copending U.S. patent application Ser. No. 050,654, filed June 21, 1979 and now abandoned discloses a power cable connector having a release tongue extending from the spring to facilitate release of the spring. While that connector has several important advantages, difficulty can be experienced when a tool, such a screwdriver, is used to release the spring. As the spring is flexed away from the terminal, the tool can enter the gap formed between the spring and the terminal. In this position the tool cannot push effectively against the terminal to move it rearward in the housing. Moreover, the tool upon entering the gap tends to wedge the terminal in the housing so that it is difficult to pull the terminal rearward by grasping the associated cables. Another difficulty with prior connectors is that it is possible to engage such connectors with other connectors when no terminal is present in the cavity.

An important object of the present invention is to provide improvements in power cable connectors and in terminal retention springs therefor. Among the other objects of the invention are to provide an improved connector wherein removal of terminals is easily and reliably accomplished in a safe manner; to provide a connector having an improved retention spring permitting terminal release by pushing against the connector with the spring releasing tool, while preventing wedging of the tool against the terminal; to provide a connector incapable of engagement with another connector unless terminals are inserted within the connector housing; and to overcome disadvantages experienced with power cable connectors used in the past.

In brief, in accordance with the above and other objects and advantages of the present invention, there is provided a power cable connector for battery cables and the like including an electrically insulating housing and at least one terminal receiving cavity extending through the housing in a longitudinal direction between forward and rear ends. A terminal is longitudinally insertable into the cavity from the rear of the housing and includes a contact portion adjacent the forward end of the terminal and a cable attachment structure adjacent the rear end of the terminal. A cantilever spring includes a base portion mounted in the housing and includes a biasing portion extending longitudinally toward the terminal contact portion and disposed between a wall of the cavity and the terminal. A latching structure defined on the biasing portion engages the terminal to prevent withdrawal of the terminal from the cavity. A release tongue defined on the biasing portion permits the biasing portion to be flexed in a transverse direction away from the terminal and toward the cavity wall to disengage the latch structure.

In accordance with the present invention, the release tongue includes a barrier portion for covering the gap formed between the terminal and the biasing portion upon disengagement of the latch structure. The barrier portion includes a segment of the release tongue extending in a transverse direction away from the cavity wall and overlying a transverse wall of the terminal.

The present invention and the objects and advantages thereof can best be understood with reference to the following detailed description of the embodiments of the invention shown in the accompanying drawing, wherein:

FIG. 6 is a fragmentary perspective view illustrating an alternative terminal retention spring.

Figure 1:
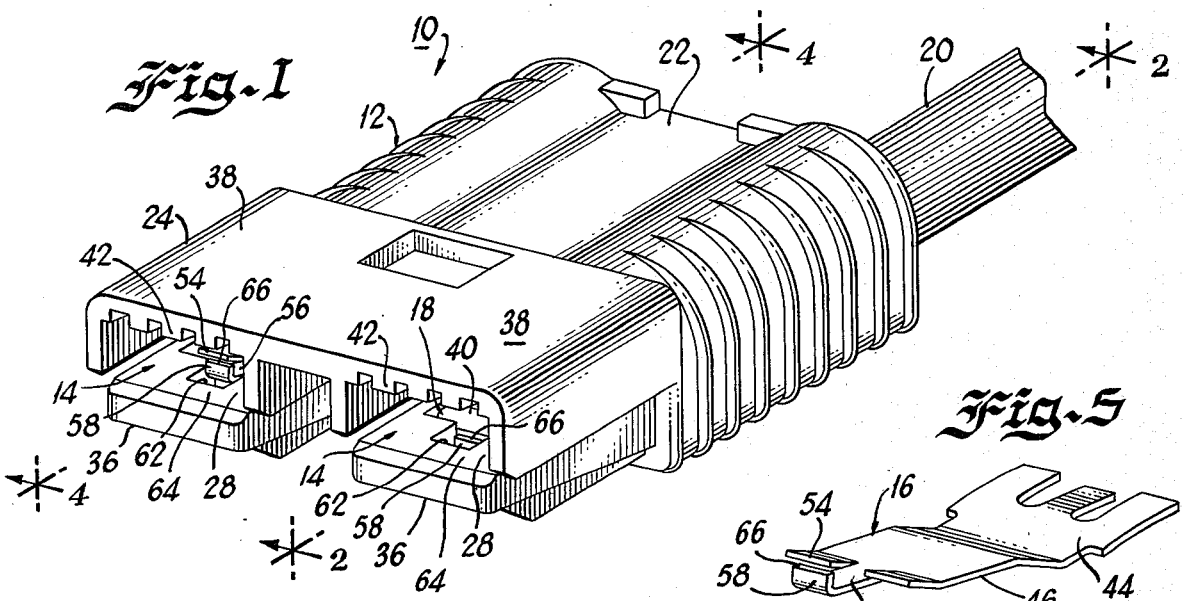
FIG. 1 is a perspective view of a power cable connector constructed in accordance with the present invention and having an electrical terminal inserted into one of the two terminal receiving cavities of the connector housing.
Figure 5:
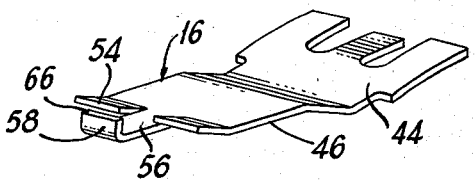
FIG. 5, is a perspective view on a reduced scale of the terminal retention spring of the connector of FIG. 1.

Having reference now to the drawings, there is illustrated a battery cable connector constructed in accordance with the principles of the present invention and designated as a whole by the reference numeral 10. The connector 10 is of the type used to interconnect and disconnect the battery or battery pack of an electric vehicle with the vehicle drive system during operation of the vehicle, or with a battery charging system during recharging of the battery or battery pack. The connector 10 is adapted to be interconnected in use with an inverted identical or similar connector. Principles of the present invention may, however, be applied to electrical connectors used for purposes other than this specific use.

In general, the connector 10 includes a housing 12 having a pair of generally parallel, laterally spaced apart, identical terminal receiving cavities 14. Each cavity 14 receives a cantilever leaf spring generally designated as 16 as well as an electrical terminal generally designated as 18 to which is attached an electrical cable 20. As illustrated in FIGS. 1–4, only one of the cavities 14 is provided with a terminal 18 and cable 20; in use, each cavity 14 is provided with a terminal 18 and the connector 10 serves to establish an electrical connection between a pair of cables 20 and other cables associated with a similar or identical connector coupled to the connector 10.

In many respects, the connector 10 is similar to the power cable connector disclosed in U.S. patent application Ser. No. 050,654 filed on June 21, 1979, now abandoned. The disclosure of that application is incorporated by reference herein and includes a detailed description of components of the connector 10 beyond that necessary for an understanding of the present invention.

Proceeding now to a more detailed description of the illustrated embodiment of the invention, the housing 12 is preferably molded as a unitary, one-piece body of plastic material such as a polycarbonate having the desired characteristics of strength and electrical insulation. The housing 12 includes a rear, cable receiving portion 22 and a forward, coupling portion 24 intended to mate with an inverted and similar coupling portion of another electrical connector.

The illustrated connector 10 is a two-pole connector and includes two identical spaced apart and side-by-side cavities 14 each extending longitudinally through the housing 12. Each cavity 14 is subdivided into a rearward cable receiving segment 26 and a forward contact receiving segment 28 by an intermediate wall 30.

The terminal 18 is formed of a relatively rigid and strong electrically conductive metal such as copper, and may be plated to reduce contact resistance. Each terminal 18 includes a rearward cable attachment structure 32 adapted to be electrically and mechanically fastened to an end of the cable 20. In the illustrated arrangement, the attachment structure 34 is cylindrical and barrel-like in shape and is secured to cable 20 by soldering, crimping or the like. The cable receiving portion 26 of cavity 14 is sized to receive the cable 20 and the cable attachment structure 32 and is of sufficient length to provide ample space between the rearward end of the terminal 18 and the rear opening or mouth of the cavity 14.

Extending forwardly from the cable attachment structure 32 of the terminal 18 is a terminal contact portion 34. In overall configuration, the contact portion 34 is generally flat and blade-like. When the terminal 18 is inserted into the cavity 14 through the rear cavity opening, the contact portion 34 extends beyond the intermediate wall 30 into the forward contact receiving portion 28 of the cavity 14. As best illustrated in FIG. 2, the wall 30 is engaged by the cable attachment structure 32 and serves as a forward stop when the terminal is fully inserted.

Coupling portion 24 of the housing 12 includes a tray structure 36 and a cover structure 38 associated with each cavity 14. The contact receiving portion 28 of each cavity 14 is defined between a tray structure 36 and the cooperating cover structure 38. Contact portion 34 of each terminal 18 includes a rounded contact surface 40 adjacent its forward end. When connector 10 is mated with an inverted similar connector, the tray structure 36 is sandwiched between similar tray and cover structures of the other connector, and the contact surface 40 engages a mating and similar contact surface of the other connector with a wiping and overlapping action. A rib and groove indexing structure 42 provides a guiding and indexing function with similar ribs and grooves of a mating connector.

In order to apply a resilient transverse bias to the terminal contact portion 34 and to retain the inserted terminal 18 within its corresponding cavity 14, the cantilever leaf spring 16 is mounted within the cavity. Spring 16 is formed of a suitable spring material such as stainless steel and includes a base portion 44 mounted within the cable receiving portion 22 of the housing 12. A biasing portion 46 of the spring 16 extends in the longitudinal and forward direction beyond the barrier wall 30 and into the contact receiving segment 28 of the cavity 14. The biasing portion 46 extends toward the terminal contact portion 34 and is disposed between the terminal 18 and an opposed longitudinally extending housing wall 48 defining part of the cavity 14.

Figure 2:
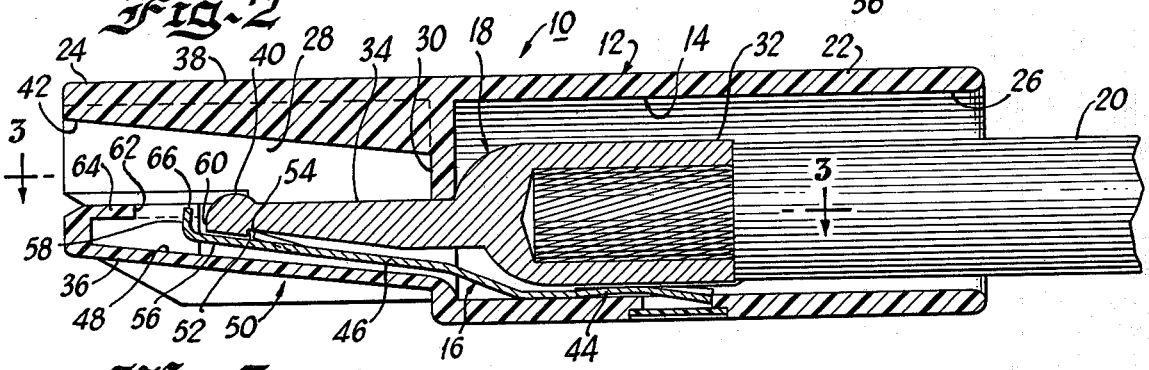
FIG. 2 is a sectional view taken along the line 2—2 of FIG. 1.
Figure 3:
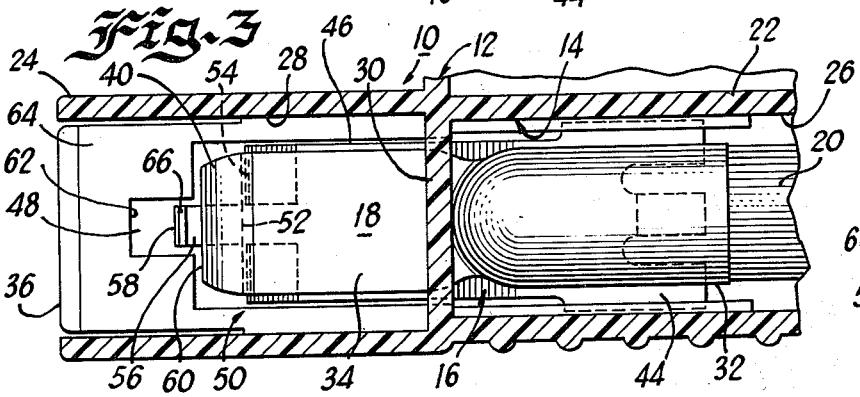
FIG. 3 is a fragmentary sectional view taken along the line 3—3 of FIG. 2.
Figure 5:
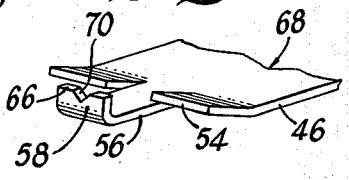

After assembly of the spring 16 and the terminal 18 within the housing 12, the biasing portion 46 of the spring applies a transverse resilient biasing force (in the upward direction as illustrated in FIG. 2) to the contact portion 34 of the terminal 18. As a result, when the connector 10 is mated with a similar connector, the contact surfaces of the engaged terminals are resiliently biased into firm contact with one another.

A latching structure generally designated as 50 is associated with the biasing portion 46 of the spring 16 in order to retain the terminal 18 within the cavity 14. The contact portion 34 of the terminal 18 includes a rearwardly facing step or ledge 52, and the biasing portion 46 of the spring 16 includes a cooperating forward latch edge or wall 54. Prior to insertion of a terminal 18 into a cavity 14, the spring 16 assumes the position illustrated in FIG. 4. As the terminal 18 is longitudinally inserted in the forward direction from the rear end of the cavity 14, the spring is flexed downwardly toward the wall 48. In the fully inserted position of FIG. 2, the biasing portion 46 of the spring is in resilient engagement with the terminal and the latch edge or wall 54 overlies the rearwardly facing ledge 52 of the terminal and the terminal cannot be withdrawn from the cavity 14.

In accordance with the present invention, the removal of terminal 18 from cavity 14 is easily and safely accomplished. For example, it may occur during use of the connector 10 that the contact surface 40 of the terminal 18 becomes damaged or pitted due to arcing when the connector 10 is used to make or break a connection under load. Such damage can result in an increase in the electrical resistance of the electrical connection resulting in even further damage to the contact surface. Consequently, it is desirable to be able to remove terminal 18 for replacement or repair.

Pursuant to the present invention, the spring 16 is provided with a longitudinally extending release tongue 56 and a transversely extending barrier portion 58. The release tongue 56 is in the form of an extension of the central portion of the biasing portion 46 of the spring 16. As best illustrated in FIG. 2, the release tongue 56 extends in the longitudinal forward direction from the latching structure 50. In the embodiment of FIGS. 1–5, the tongue 56 extends slightly beyond the forwardmost end wall 60 of the terminal 18. The barrier portion 58 is formed as a bent end segment of the release tongue 56 and extends in the transverse direction away from the housing wall 48. The barrier portion 58 overlaps the transverse terminal wall 60 to an extent which is at least as great as the spacing between the biasing portion 46 and the housing wall 48.

When terminal 18 is to be removed from cavity 14 of housing 12, any suitably sized and readily available tool such as a screwdriver is inserted into the forward end of the cavity 14. Access to the release tongue 56 and the barrier portion 58 is facilitated by an access opening 62 formed in an inner wall 64 provided on the tray structure 40. The blade of the tool can be placed against the edge or end 66 of the barrier portion 58. The barrier portion 58 and release tongue 56 can then be flexed away from the terminal 18 and toward the housing wall 48 until the latching structure 50 is released by moving the edge 54 clear of the ledge 52. Movement in this transverse direction is limited by engagement of the biasing portion 46 against the housing wall 48.

During flexing of the biasing portion 46, the barrier wall 58 continues to cover and obstruct the gap formed between the spring biasing portion 46 and the terminal contact portion 34. Consequently, the screwdriver or other tool cannot become wedged between the spring and the terminal. Such wedging would result in forcing the terminal contact portion 34 transversely away from the wall 48. The consequent reaction force between the intermediate wall 30 and the terminal 18 would prevent or interfere with withdrawal of the terminal 18 from the cavity 14.

Since the barrier portion 58 serves to hold the screwdriver or other tool above the gap between the spring 16 and the terminal 18, the tool can readily be used not only to flex the spring 16 in a direction to release the latching structure 50, but also to push the terminal in the longitudinal direction toward the rear of the cavity 14. Thus, the tool can conveniently be used to move the terminal 18 sufficiently to the rear so that the latching structure 50 is disabled. Thereafter, the tool can be removed and the terminal 18 can be fully removed from the housing 12 simply by grasping the cable 20 and pulling the cable with the attached terminal 18 to the rear of the housing 12.

Figure 4:
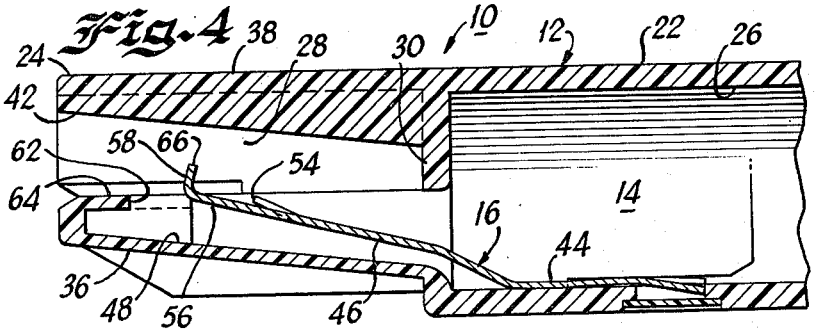
FIG. 4 is a fragmentary sectional view taken along the line 4—4 of FIG. 1.

Having reference to FIG. 4, it can be seen that the barrier portion 58 blocks the cavity 14 prior to insertion of a terminal 18. If an attempt is made to mate the connector 10 with another connector prior to insertion of a terminal, the barrier portion 58 interferes with the terminal and/or retention spring of the other connector and prevents complete coupling. This interference serves to inform the user of the absence of a terminal in the cavity 14.

In FIG. 6 there is illustrated a retention spring generally designated as 68 of an alternative form. The spring 68 differs from the spring 16 in that the edge or end wall 66 of the barrier portion 58 is provided with a recess or notch 70. The function of notch 70 is to locate or position the tip of a tool such as a screwdriver blade in the proper position relative to the spring and terminal to accomplish release of the latching structure 50 and rearward movement of the terminal 18.

Figure 7:
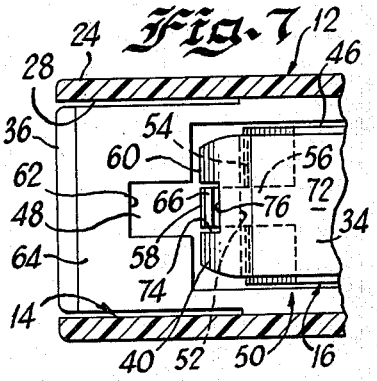
FIG. 7 is a fragmentary sectional view, similar to a portion of FIG. 3, illustrating an alternative embodiment of the present invention.

In FIG. 7 there is illustrated an alternative embodiment of the invention. In this embodiment, a terminal 72 otherwise similar to the terminal 18 is provided with a recess or notch 74 in its forward end wall 60. When this terminal configuration is used, the release tongue 56 of the terminal does not extend beyond the forward end wall 60. Rather, the barrier portion 58 is received in the notch 74 and overlies a transverse wall 76 formed as the inner or base wall of the notch 74.

Other than as specifically described above, the modifications illustrated in FIGS. 6 and 7 may be identical with the structure described in connection with FIGS. 1–5. Consequently, identical reference numerals have been used to designate similar components of the structures.

While the invention has been described with reference to details of the embodiments illustrated in the drawings, these details are not intended to limit the scope of the invention as defined in the following claims.

What is claimed and desired to be secured by Letters Patent of the United States is:

1. In a power cable connector for battery cables and the like;
- a housing formed of electrically insulating material;
- at least one terminal receiving cavity extending through said housing in a longitudinal direction between forward and rear ends of the housing;
- a terminal longitudinally insertable into said cavity from the rear end of said housing and including a contact portion adjacent the forward end of the terminal and a cable attachment structure adjacent the rear end of the terminal;
- a cantilever spring including a base portion mounted in said housing and including a resiliently flexible biasing portion extending in the longitudinal direction toward the contact portion of said terminal and disposed between a wall of said cavity and said terminal;
- a latching structure defined on said biasing portion engageable with said terminal to prevent withdrawal of said terminal from said cavity;
- a release tongue defined on said biasing portion permitting said biasing portion to be flexed in a transverse direction away from said terminal and toward said cavity wall to disengage said latching structure;
- and the improvement comprising:
  - a barrier portion defined on said release tongue for covering the gap formed between said terminal and said biasing portion upon disengagement of said latch structure;
  - said barrier portion comprising a segment of said release tongue extending in a transverse direction away from said cavity wall and overlying a transverse wall of said terminal.

2. A power cable connector as claimed in claim 1, said transverse wall comprising the forward end of the terminal contact portion.

3. A power cable connector as claimed in claim 1, said transverse wall being defined in a recess formed in the forward end of the terminal contact portion.

4. A power cable connector as claimed in claim 1, said barrier portion comprising a transversely bent end portion of said release tongue.

5. A power cable connector as claimed in claim 1, said barrier portion overlapping said terminal transverse wall by a distance at least as great as the distance between said cavity wall and said biasing portion in the terminal latched condition.

6. A retention spring for use with an electrical connector of the type having a terminal cantilever-mounted in a connector housing upon insertion of the terminal in a longitudinal direction into a cavity in the housing, said retention spring comprising:

a generally planar body of flexible and resilient material including a base portion adapted to be secured in said cavity;

a biasing portion extending in the longitudinal direction adjacent the terminal and including latch structure normally self-biased into latching engagement with the terminal;

a release tongue extending from the region of said latching structure in the longitudinal direction and permitting release of the terminal in response to flexing of said biasing portion in a first transverse direction away from said terminal;

and the improvement in accordance with which said release tongue includes a barrier portion extending from the longitudinal plane of said biasing portion in the opposed transverse direction and overlapping a transverse wall of the terminal.

7. A retention spring as claimed in claim 6 wherein the extent of overlap of said barrier portion and terminal wall exceeds the distance through which said biasing portion is flexed for release of the terminal.

8. A retention spring as claimed in claim 6 wherein said barrier portion is defined by a bend formed in the end of said biasing portion.

9. A retention spring as claimed in claim 8 wherein the end of said barrier wall includes a notch.

10. A retention spring as claimed in claim 8 wherein the end of said barrier portion lies generally in a straight line.

* * * * *